US005448947A

United States Patent [19]

Mathot

[11] Patent Number: 5,448,947

[45] Date of Patent: Sep. 12, 1995

[54] COMBINATION LINER AND SPIN BEARING FOR PRESS ROLLER MECHANISM

[76] Inventor: Ernest R. Mathot, 2551 E. Larkwood St., West Covina, Calif. 91791

[21] Appl. No.: 320,219

[22] Filed: Oct. 11, 1994

[51] Int. Cl.[6] ..... B41F 1/46

[52] U.S. Cl. ..... 101/348; 101/DIG. 38

[58] Field of Search ..... 101/348, 349, 350, 351, 101/DIG. 38, 352, 363, 366, 207, 208, 209, 210

[56] References Cited

U.S. PATENT DOCUMENTS

| | | | |
|---|---|---|---|
| 700,260 | 5/1902 | Thomson | 101/348 |
| 717,138 | 12/1902 | Thomson | 101/348 |
| 717,139 | 12/1902 | Thomson | 101/348 |
| 717,239 | 12/1902 | Mellen | 101/348 |
| 809,521 | 1/1906 | McKinley | 101/348 |
| 892,700 | 7/1908 | Wilson | 101/348 |
| 1,022,563 | 4/1912 | McKinley | 101/348 |
| 1,194,004 | 8/1916 | Frackelton et al. | 101/348 |
| 1,584,256 | 5/1926 | Temmen | 101/348 |
| 2,040,331 | 5/1936 | Peyrebrune | 101/348 |
| 2,745,343 | 5/1956 | Davis | 101/348 |
| 2,928,341 | 3/1960 | Taylor | 101/348 |
| 4,397,236 | 8/1983 | Greiner et al. | 101/350 |
| 4,509,426 | 4/1985 | Hardin | 101/348 |
| 4,672,894 | 6/1987 | Hardin | 101/348 |
| 4,869,167 | 9/1989 | Villarreal | 101/348 |
| 5,065,676 | 11/1991 | Hardin | 101/349 |
| 5,205,215 | 4/1993 | Witczak | 101/348 |

*Primary Examiner*—Chris A. Bennett
*Attorney, Agent, or Firm*—William W. Haefliger

[57] ABSTRACT

For combination with apparatus, including a printing press roller that oscillates along a roller axis and relative to a cam, and in response to tracking of a follower in reversing spiral grooves defined by the cam, the cam also having a cylindrical surface intersected by the grooves comprising a shaft carrying the cam and on which the roller oscillates, endwise; first bearing annular sleeve structure associated with the roller and receiving the shaft; first axially spaced stops carried by the sleeve structure; first bearing rollers spaced about the axis and located between the shaft and the bearing sleeve structure, and a first cage for the rollers allowing axial shifting of the cage and rollers between the stops, the axial spacing between the stops substantially exceeding the width of the cage and rollers.

9 Claims, 6 Drawing Sheets

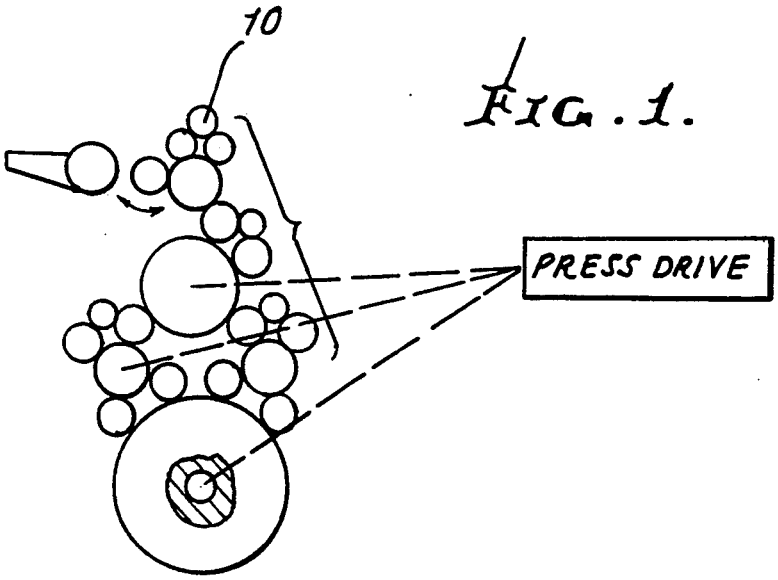
FIG. 1.
FIG. 2.
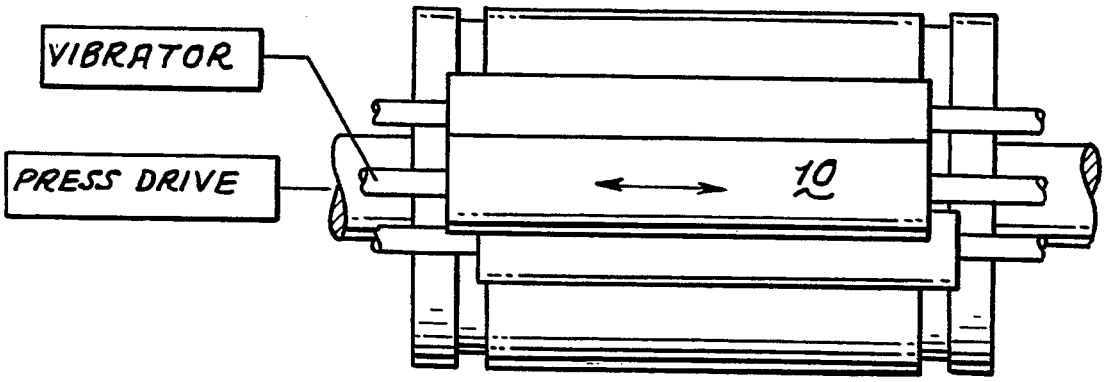
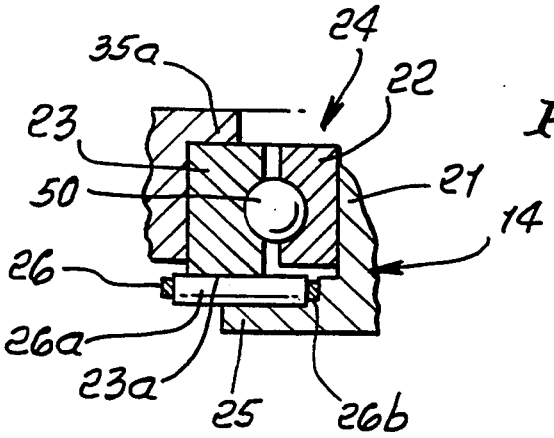
FIG. 4.

COMBINATION LINER AND SPIN BEARING FOR PRESS ROLLER MECHANISM

BACKGROUND OF THE INVENTION

This invention relates generally to apparatus for endwise oscillating printing press rollers, and more particularly, to improvements in support mechanism associated with such rollers.

Printing press rollers, as for example ink distributing rollers, are required to oscillate endwise back and forth, in press operation. This is normally accomplished by employing a follower on the roller, the follower tracking in spiral duplex cam grooves that are so configured as to cause the follower to track back and forth in the grooves as the idler rotates. See for example U.S. Pat. Nos. 717,138; 700,260; and 2,745,343. The roller may be suitably rotated, as by auxiliary rollers.

The cam is normally carried by a shaft relative to which the roller rotates and moves axially back and forth at very high speeds. It is found that excessive bearing wear can occur, contributing to catastrophic failure and explosion of parts, including the roller, follower and cam, whereby costly shutdown of the printing press can and does occur. There is need for improvements in mechanism construction which will obviate such failure.

SUMMARY OF THE INVENTION

It is a major object of the invention to provide improved apparatus meeting the above need. Basically, the improved apparatus, for combination with the oscillating roller and cam with spiral duplex grooves, includes:

a) a shaft carrying the cam and on which the roller oscillates, endwise, b) first bearing annular sleeve means associated with the roller and receiving the shaft, c) first axially spaced stops carried by the sleeve means, first bearing rollers spaced about the axis and located between the shaft and the bearing sleeve means, and a first cage for the rollers allowing axial shifting of the cage and rollers between the stops, the axial spacing between the stops substantially exceeding the width of the cage and rollers.

As will be seen, the stops typically comprise snap rings carried by the bearing sleeve means and projecting in the path of the axial shifting of the cage and rollers. The rollers are typically loosely confined between the axial sleeve means and the shaft, to permit axial misalignment between the shaft and bearing sleeve means.

It is another object to provide the rollers in the form of bearing balls extending in a plane that is substantially perpendicular to the axial, the balls spaced about the axis, the plane defined by the balls adapted to wobble in response to misalignment of the shaft and bearing sleeve means as the shaft rotates and travels axially.

Yet another object is the provision of:

e) second axially spaced stops carried by the sleeve means, f) second bearing rollers spaced about the axis and located between the shaft and the bearing sleeve means, and a second cage for the second rollers allowing axial shifting of the second cage and second rollers between the second stops, the axial spacing between the second stops substantially exceeding the width of the second cage and second rollers.

As will be seen, the second stops and the second bearing rollers, and the second cage, are spaced axially from the first stops, the first: bearing rollers and the first cage, the first and second cages independently movable axially or rotatably. In this regard, the follower typically has a projection that projects into the cam groove and generally toward the shaft axis, and the projection is located between the first and second cages.

These and other objects and advantages of the invention, as well as the details of an illustrative embodiment, will be more fully understood from the following specification and drawings, i:n which:

DRAWING DESCRIPTION

FIG. 1 shows rollers in an inking unit in an offset press;

FIG. 2 is a plan view of rollers in FIG. 1;

FIG. 4 is an enlarged section showing radial and thrust bearings;

BACKGROUND ENVIRONMENT

Figure 3:
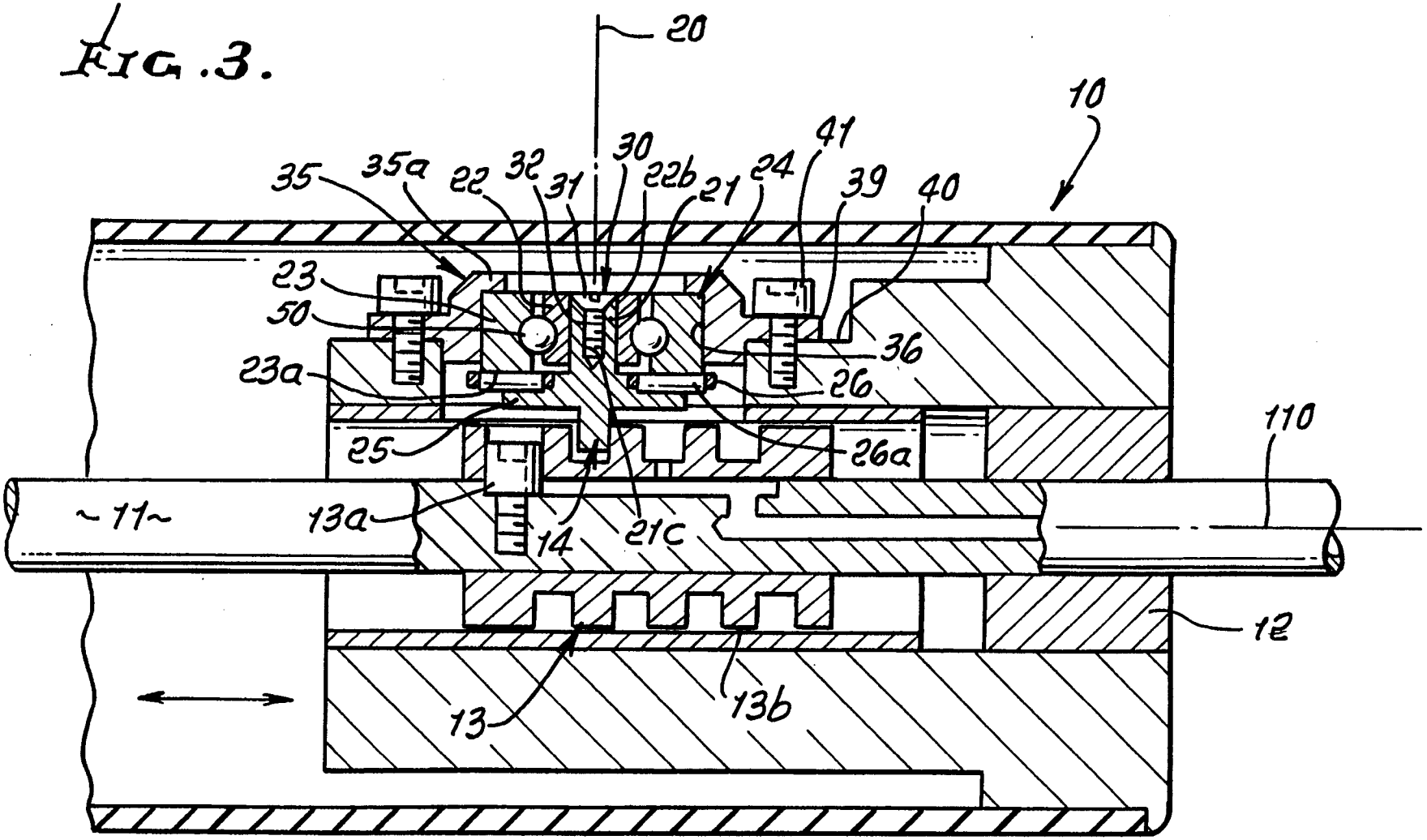
FIG. 3 is an elevation taken in axial section through apparatus incorporating the invention.
Figure 5:
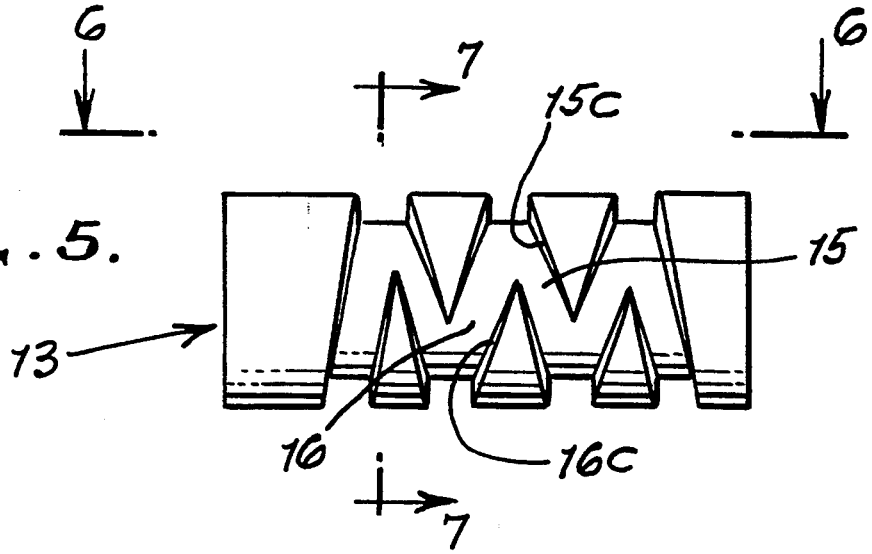
FIG. 5 is a side elevation showing a cam as used in the FIG. 3 apparatus.
Figure 6:
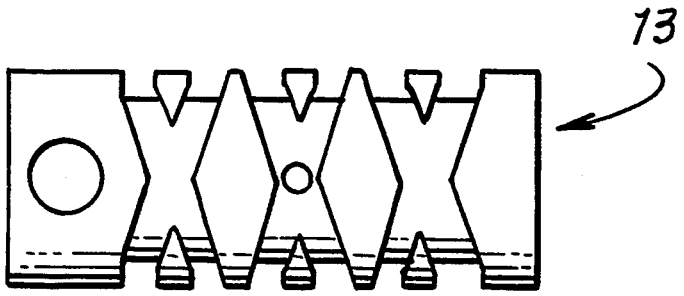
FIG. 6 is a top plan view of the FIG. 5 cam taken on lines 6—6 of FIG. 5.
Figure 7:
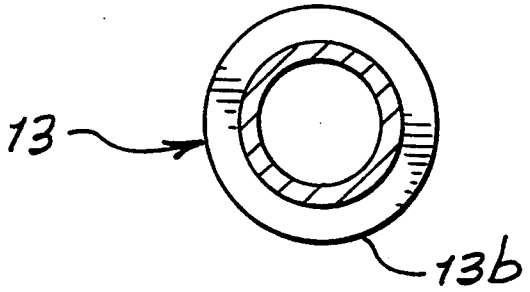
FIG. 7 is a section taken on lines 7—7 of FIG. 5.
Figure 8:
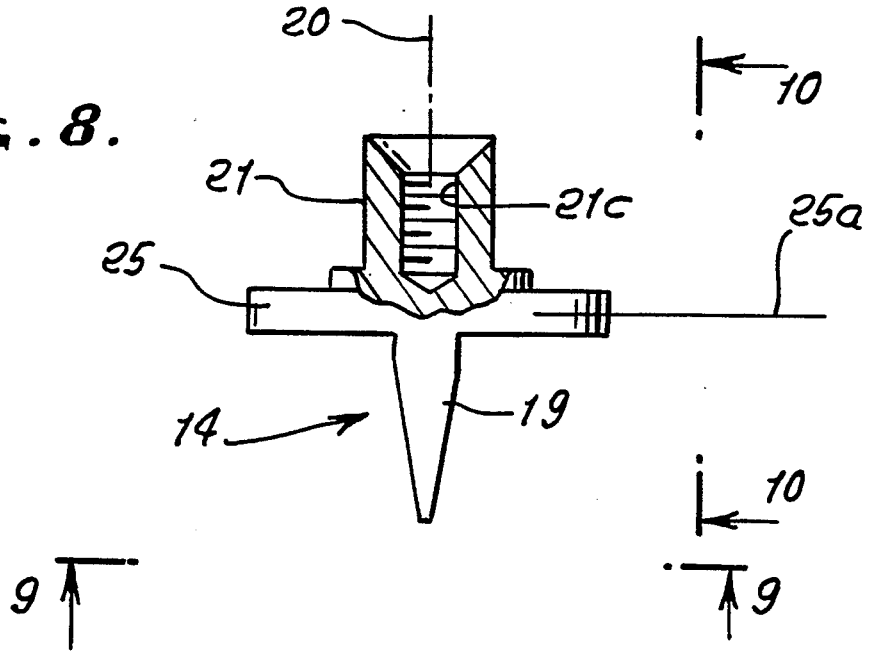
FIG. 8 is an enlarged side elevation showing the follower as used in FIG. 3.
Figure 11:
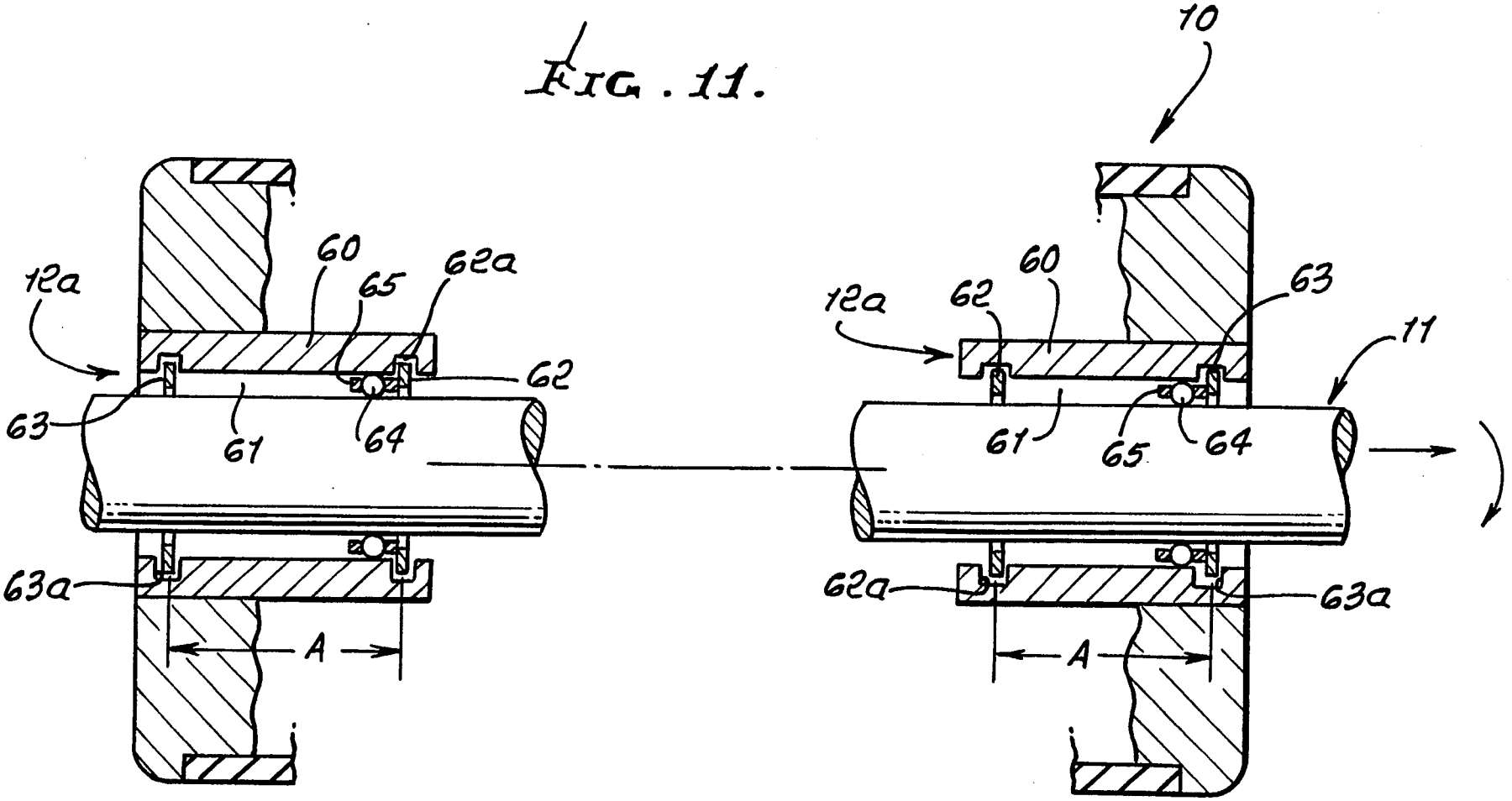
FIG. 11 is an elevation showing bearing construction.
Figure 12:
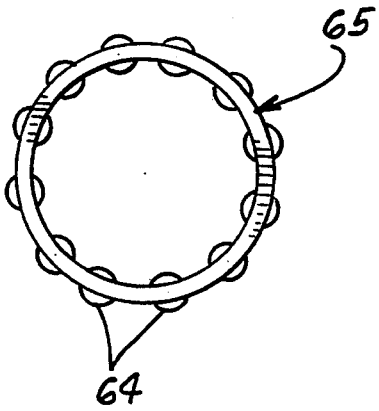
FIG. 12 is a front view of a bearing cage.
Figure 13:
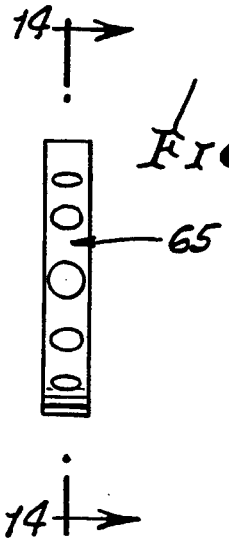
FIG. 13 is an end view of the FIG. 12 bearing cage.
Figure 14:
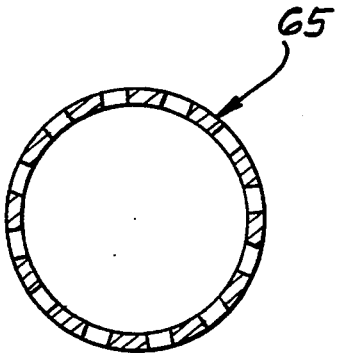
FIG. 14 is a section taken on lines 14—14 of FIG. 13.

In FIG. 3, a printing press roller 10, as for example an ink distribution roller also seen in FIGS. 1 and 2, rotates about an axis 110 relative to a coaxial shaft 11. Bearings 12 support the roller on the shaft for such rotation. See FIG. 11 for details of the bearings.

The shaft carries a cam 13, which causes the roller to oscillate endwise axially back and forth, in response to roller rotation. Fasteners **13*a* connect the cam sleeve to the shaft. Oscillation is effected by a follower 14 carried by the roller, and tracking in the non-rotary spiral duplex grooves 15 and 16 formed by the cam. At the ends of grooves, the follower, having tracked along one groove, is caused to reverse and track back along the other groove. Such tracking, and back and forth roller oscillation, are known in the art, as described in the above-listed patents. The cam has a cylindrical, outer surface 13*b*** presented toward the follower; and in the past, the follower tended to frictionally rub against that surface, producing excessive wear at high speed rotation of the roller, and destructive failure of the roller. Excessive rubbing also occurred at the side walls of the groove, engaged by the follower.

The follower may provide for both primary rotary bearing support of the follower about a second axis 20, and thrust-bearing support of the follower in the direction of axis 20, thereby allowing ready, low friction tracking conformance of the follower to the duplex grooves of the cam, i.e., about axis 20, as well as endwise positioning of the follower out of rubbing engagement with the cam cylindrical outer surface is also facilitated during such high speed tracking. Lubricant in the grooves also lowers friction.

The follower may have a projection 19 in the form of a crescent, that projects in the cam grooving generally toward first axis 11, and a cylindrical stem 21 to be supported by the inner race 22 of a ball-bearing unit 24, the axis 20 being defined by the stem, and extending generally radially relative to axis 11. See FIG. 4. Stem 21 may remain outside the grooves and is shown as spaced outwardly relative to the projection 19; and the bearing supported stem typically allows the follower to pivot in the cam groove, as during reversal of tracking, minimizing rubbing friction.

The follower may also be provided with an annular flange 25 extending about the second axis and at a planar location (see plane 25*a*) between the stem 21 and projection 19. The flange typically engages the thrust bearing in the form of pins 26*a* projecting radially relative to axis 20, and carried by cage or washer 26, extending in a plane parallel to that of the flange. The roller pins may be spaced about axis 20. The washer is typically supported at 26*b* and the pins are located between and engage the flange upper side and the lower side 23*a* of the bearing outer race 23. Bearing balls 50 locate race 22 relative to race 23. Upon urging of the flange upwardly, the flange and thrust bearing typically precisely locate the projection 19 in the groove to have contact with the cam only at the groove side walls, preventing destructive frictional rubbing of the follower and cam at high speed rotation of the roller. Such rotation may be effected by another roller or rollers engaging the surface of roller 10, as is known.

The follower is retained endwise to the primary bearing 24 (i.e., to race 23), whereby the thrust bearing is clamped between the bearing 24 and the flange in a follower locating condition, as described above. Free rotation of the follower is allowed about axis 20, and thrust absorption by the thrust bearing occurs. The retainer means may comprise a threaded fastener 30 having a tapered head 31 engaging the upper side 22*b* of the inner race 22, as at a countersink, and a threaded shank 32 threadably engaging the follower stem, as in a stem threaded bore 21*c*.

The position of the flange 25 and projection 19 relative to the cam can be adjusted to prevent rubbing against the cam outer surface, and rubbing against the cam groove inner surface or surfaces 15*c* and 16*c*. Also, the flange and thrust bearing may protectively underlie the bearing balls 50, preventing their direct radial exposure to the tracking grooves 15 and 16. Note that the position of the outer race 23 typically is fixed relative to the roller, so that clamping of the thrust washer to the underside of the outer race by the flange may fix the position of the follower in the direction of axis 20, despite the use of the ball bearing unit, to allow rotation of the follower about axis 20.

Figure 9:
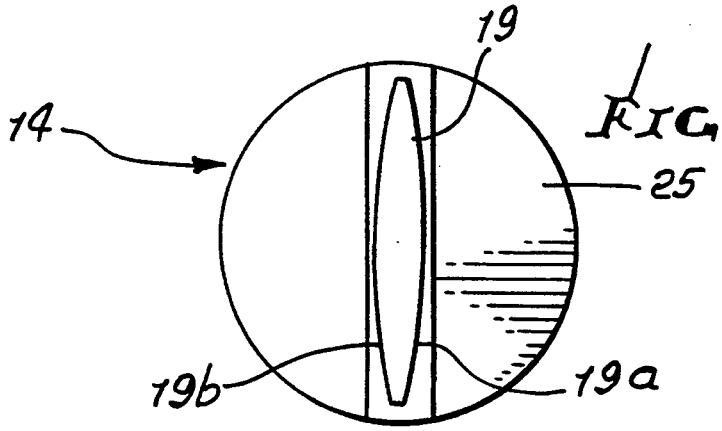
FIG. 9 is an end view taken on lines 9—9 of FIG. 8.
Figure 10:
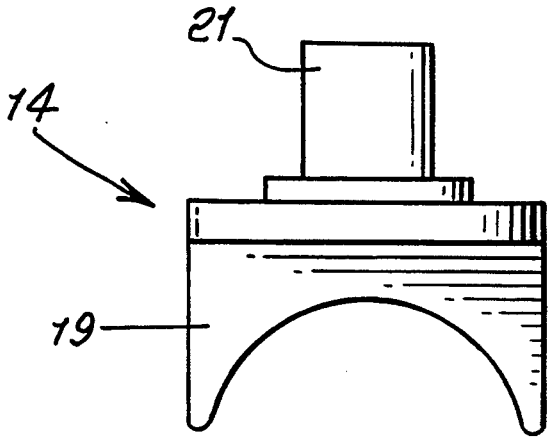
FIG. 10 is a side elevation taken on lines 10—10 of FIG. 8.

FIG. 9 shows that opposite sides 19*a* and 19*b* of the projection have outward convexity, for minimizing rubbing contact with the groove side walls.

FIG. 3 also shows the provision of annular support structure 35 for the bearing unit outer race. Structure 35 defines a bore 36 receiving the outer race, as by an interference fit. The structure 35 has a lip 35*a* overhanging the bearing outer race to position the bearing in the direction of axis 20. The structure 35 has a support flange 39 which overhangs roller local flat surface 40, with fasteners 41 removably attaching the flange 39 to the roller. Removal of the bearings and follower as a unit is enabled, for that replacement, if necessary. The head of the adjustment fastener 30 may remain exposed, for ease of adjustment.

DETAILED DESCRIPTION OF BEARING INVENTION IMPROVEMENTS

Referring now to FIGS. 11–15, the roller 10 is rotatable and movable endwise back and forth on the shaft 11 at high speeds, the shaft guiding such roller movement. Catastrophic failure can occur if the bearings fail; however, the improved bearings 12*a* prevent such catastrophic failure, since they incorporate roller bearing elements, which move both axially and rotatably with the roller. These improved results are enabled not only for the device described above, but for other printing press roller devices.

Figure 15:
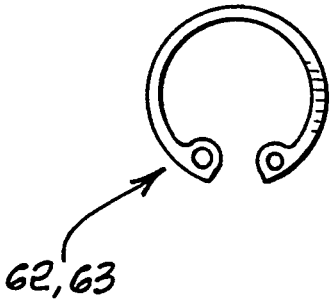
FIG. 15 is a front view of a snap ring.

As shown, the bearing units 12*a* are spaced apart axially, at opposite sides of the follower 14. Each unit 12*a* includes a sleeve means 60, spaced radially from the shaft 11 (see gap 61) and extends about the shaft. The unit 12*a* also includes two stops 62 and 63, which are axially spaced apart and carried by the sleeve means 60. Stops 62 and 63 preferably comprise snap rings, as best seen in FIG. 15. Those rings are received in annular grooves 62*a* and 63*a* formed in the sleeve means, so that the snap rings project into the gap Each unit 12*a* also includes bearing rollers, such as balls 64, spaced about the shaft axis and located in the gap 61, to support the roller for relative rotation and endwise rotation on the shaft. An annular cage 65 loosely retains the balls 64 at circularly spaced locations with cage structure extending between successive balls, as shown. The balls rotate relative to the cage, as the roller relatively rotates and moves back and forth, axially. Also, the cage moves endwise between the stops, or snap rings, in response to such shaft and roller relative movement carrying the stops endwise relative to the shaft. Engagement of the cage with first one stop, and then the other, acts to bring the cage axis into alignment with the shaft axis, should any cage misalignment or wobble occur. Lubricant, such as grease, is supplied to the gap 61.

The axial distance or length "A" between the snap rings is approximately equal to one half the relative lateral travel "d" of the roller on the shaft. More precisely:

$$A = \frac{d}{2} + w + c$$

where w=cage width and c=constant substantially less than w

In a typical case, for example:

A=0.715 inch d=1 inch w=0.200 inch c=0.015 inch

Accordingly, with the construction as described, the risk of catastrophic failure is minimized.

I claim:

1. In combination with apparatus that includes a follower, and a cam having reversing spiral grooving, and including a printing press roller that has an axis and oscillates along said roller axis and relative to said cam, and in response to tracking of the follower in said reversing spiral grooving defined by the cam, the cam also having a cylindrical surface intersected by the grooving, the improvement comprising:

a) a shaft carrying the cam and on which the roller oscillates, endwise, b) a first bearing annular sleeve associated with the roller and receiving the shaft, c) first axially spaced stops carried by the sleeve, d) first bearing rollers spaced about said axis and located between the shaft and the bearing sleeve, and a first cage for said rollers allowing axial shifting of the cage and rollers between said stops, the axial spacing between said stops substantially exceeding the width of said cage and rollers.

2. The improvement of claim 1 wherein said stops comprise snap rings carried by the bearing sleeve and projecting in the path of said axial shifting of the cage and rollers.

3. The improvement of claim 1 wherein the rollers are loosely confined between the axial sleeve and the shaft, to permit axial misalignment between the shaft and bearing sleeve.

4. The improvement of claim 3 wherein the rollers comprise bearing balls extending in a plane that is substantially perpendicular to said axis, the balls spaced about said axis, the plane defined by the balls adapted to wobble in response to misalignment of the shaft and bearing sleeve as the shaft rotates and travels axially.

5. The improvement of claim 1 that includes e) second axially spaced stops carried by the sleeve, f) second bearing rollers spaced about said axis and located between the shaft and the bearing sleeve, and a second cage for said second rollers allowing axial shifting of the second cage and second rollers between said second stops, the axial spacing between said second stops substantially exceeding the width of said second cage and second rollers.

6. The improvement of claim 5 wherein said second stops and said second bearing rollers and said second cage are spaced axially from said first stops, said first bearing rollers and said first cage, the first and second cages independently movable axially and rotatably.

7. The improvement of claim 6 wherein the stops comprise snap rings carried by the bearing sleeve, the first stops projecting in the path of axial shifting of the first cage and first rollers, as the roller shifts endwise, and the second stops projecting in the path of axial shifting of the second cage and second rollers, as the roller shifts axially endwise.

8. The improvement of claim 5 wherein there are: a flange on the follower extending about said second axis at a location between the stem and projection, a primary bearing supporting the stem for rotation about said second axis, allowing the follower projection to pivot in the cam grooving to minimize rubbing friction.

9. The improvement of claim 1 wherein the follower has a projection that projects into the cam grooving and generally toward said axis, the follower has a stem that projects endwise away from said roller axis, and outside the grooving, the stem defining a second axis, and the projection is located between said first cage and said second cage.

* * * * *